United States Patent [19]

Scholz

[11] 4,029,031

[45] June 14, 1977

[54] DEVICE FOR PROVIDING RUGS AND THE LIKE WITH TUFTS

[76] Inventor: Hartmut Scholz, Wolfsteiner Strasse 10, 8501 Allersberg, Germany

[22] Filed: Mar. 10, 1976

[21] Appl. No.: 665,436

[30] Foreign Application Priority Data

Mar. 14, 1975 Germany ..... 2511266

[52] U.S. Cl. ..... 112/80

[51] Int. Cl.[2] ..... D05C 15/06

[58] Field of Search ..... 112/80, 79 R, 79 A, 112/79 FF, 78

[56] References Cited

UNITED STATES PATENTS

| | | | |
|---|---|---|---|
| 739,447 | 9/1903 | Roberts | 112/80 |
| 1,976,709 | 10/1934 | Doubler | 112/80 |
| 2,226,632 | 12/1940 | Miller et al. | 112/80 |
| 2,605,727 | 8/1952 | Hurley | 112/80 |

FOREIGN PATENTS OR APPLICATIONS

| | | | |
|---|---|---|---|
| 2,402,811 | 7/1975 | Germany | 112/80 |
| 473,702 | 10/1937 | United Kingdom | 112/80 |

*Primary Examiner*—H. Hampton Hunter

[57] ABSTRACT

An arrangement for manually tufting rugs in which a fixed needle guides the thread and penetrates the base fabric. A blade is disposed movably in longitudinal direction relative to the needle for cutting the thread after the formation of each loop, at the head of the loop. Two arms are arranged next to each other and guided movably in longitudinal direction for alternately contacting the base fabric with a leading contact surface provided on each of the arms. One of the arms supports the needle which projects from the contacting surface, whereas the other arm supports the blade which projects over the contacting surface. The blade has a mechanism which is engaged with a guiding member of the other arm for opening the blade. The latter is closed by a spring when in substantially its most advanced position. The needle is provided with a curved point bent in the direction of the tufting operation.

25 Claims, 14 Drawing Figures

FIG. 1
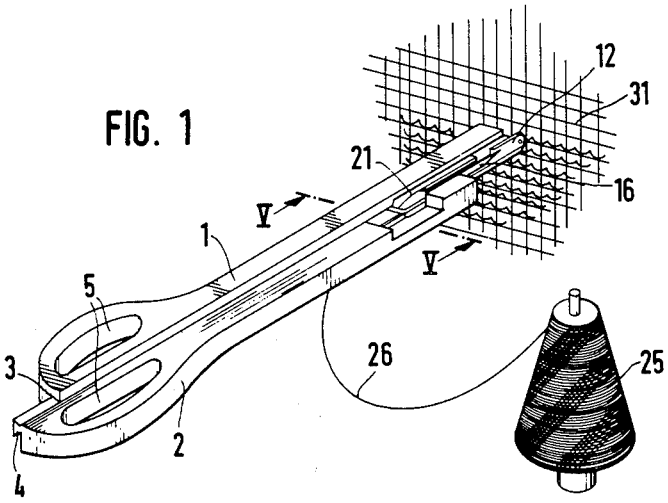
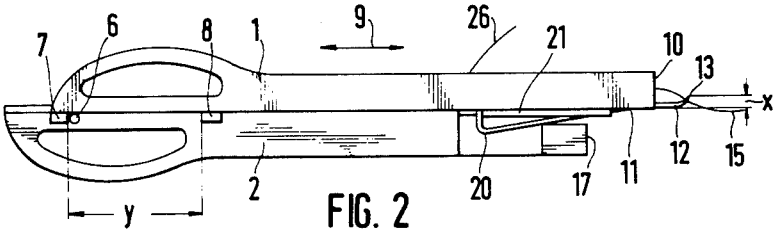
FIG. 2
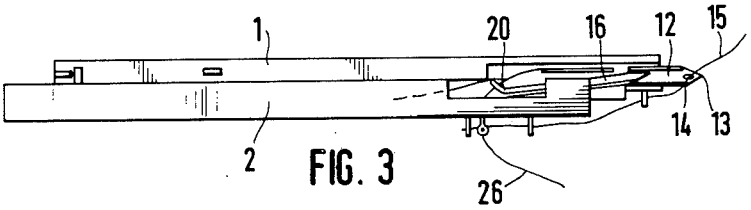
FIG. 3

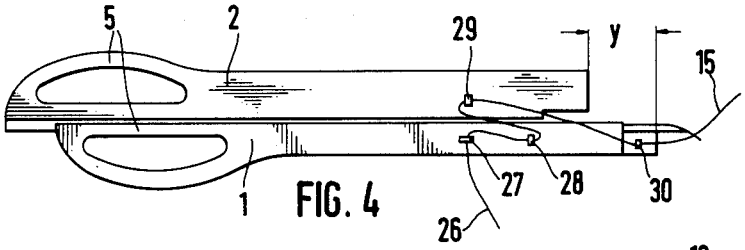
FIG. 4
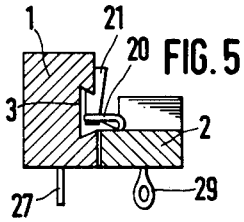
FIG. 5
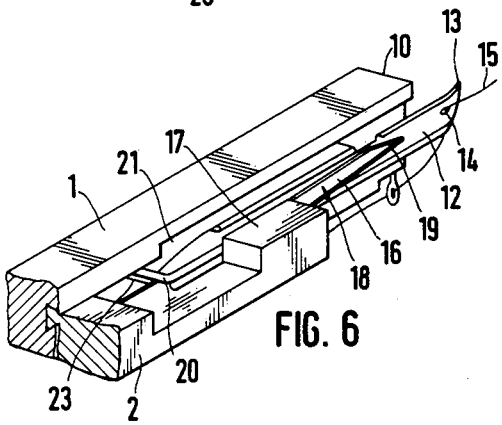
FIG. 6
FIG. 7
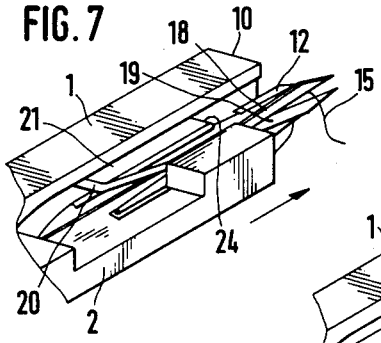
FIG. 8
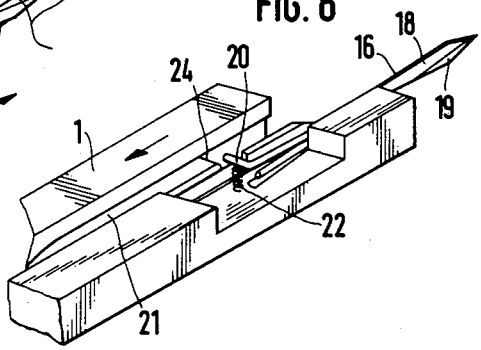

DEVICE FOR PROVIDING RUGS AND THE LIKE WITH TUFTS

BACKGROUND OF THE INVENTION

The present invention relates to a device for manually providing rugs and the like with tufts. It is comprised of a needle which guides the thread and penetrates the base fabric, and a blade for cutting the thread after each looping motion. Manual tufting work generally comprises the use of precut lengths of thread which are individually inserted in an extremely time-consuming manner and secured on the base fabric. An older proposal provides for the tufting of rugs by hand by a device which is driven mechanically, generally with the help of an electric motor, and which uses a flow of compressed air for feeding the thread. However, in many cases comprising the use of such a device, no source of compressed air is available, and in many cases neither are any electric outlets, so that such a device cannot be used. This is more particularly the case in underdeveloped countries, or regions, in which, labor is sufficiently in supply and traditionally engaged in the manufacture of such articles. In order to avoid, in such cases, the further use of precut lengths of thread and highly unproductive manual work, it is the object of the present invention to provide a device which eliminates the need of manual work for the insertion of the loops while not requiring any source of compressed air, and if unavailable, any supply system of electric power or the like.

SUMMARY OF THE INVENTION

According to the present invention, this object is achieved in a surprisingly simple manner by providing a device, of the above type, with two arms which are disposed one next to the other and move longitudinally relative to each other. Each of these two arms is provided with a leading contact surface area. The one arm supports the needle which projects over the surface area. The other arm supports the blade which is also protruding over the respective contact surface area. This blade slides during the operation of the device along the needle and is provided with a guiding member which engages with the other arm and serves the purpose of opening the blade. The latter on the other side, closes under the action of a spring when in its substantially foremost position.

This device is operated manually in such a manner that the two arms slide in each case alternately on each other in such a way that the needle first penetrates the base fabric, thereby guiding the end of the practically endless thread through the base fabric, while the contact surface rests on the base fabric. Subsequently, as a result of the relative motion between the two arms, the other arm supporting the blade, is advanced into its forward position where it receives the thread while its contact surface rests simultaneously on the base fabric. After the needle has finally returned together with the other arm, the cut is made, and the loop is formed on the tufted side of the base fabric is separated. This action is repeated constantly, with one loop being inserted and separated from the thread supply in each step, if one thread is used. This device offers the considerable advantage that it may be operated without requiring any energy sources, at least not a supply of compressed air. On the other hand, if a supply of compressed air is available, the production in this tufting of rugs may be substantially increased.

Prior to each renewed penetration of the needle though the base fabric, the device may be displaced by hand by one respective spacing between the tufts, so that the necessary progress of the tufting operation is achieved. However, according to a further development of the present invention, the working end of the needle is provided with a bent or curved peak, or point, which is curved in the direction in which the tufting work progresses. Since this curved peak will be the first portion of the needle which comes in contact with the base fabric, the entire device is displaced for each penetration by the measure of the lateral curvature of the needle point in the direction in which the tufting work progresses.

According to a further feature of the present invention, the needle forms a groove which is concavely curved toward its side, guiding the blades. This embodiment of the needle will enhance the guiding motion of the blade which now will safely contact the loop guided by the needle.

The feeding or advancing of the thread is achieved by a guiding arrangement in which the thread is guided to the needle by way of the two arms moving relative to each other with a maximum stroke. This substantially corresponds to the total length of the thread forming the loop. This arrangement may be provided in such a way that the advance of the arm supporting the needle coincides with the withdrawal of required thread from the thread supply, provided in the form of a coil or the like. During the subsequent return motion of the needle, and particularly after the separation or cutting of the thread by the blade, the free end of the thread finds sufficient resistance within the base fabric, so that the end will not be returned, but will slide through the eye of the needle.

It is, furthermore, within the scope of the present invention that the blade is substantially provided in the form of a pair of scissors of which one shank is secured on the associated arm while the other movable shank is provided with the guiding member. The latter movable shank is subjected to the force of a spring in the direction of the closing — or cutting — motion. Although a single blade will, of course, be sufficient for cutting the thread, a single blade may then work, if need be, against a stationary resisting element. The method of the present invention providing for a blade having the form of a pair of scissors will considerably facilitate the function of the device. The opening and closing motions of the scissors then necessarily coincide with the relative motion of the arms with respect to each other. It is advantageous if the trailing end of the movable shank of the scissors engages in a guiding path disposed on the other arm. This guiding path ends with a stroke of the arm that conforms to the cut. The guiding path, or sliding block or the like, thus effects the opening of the blade, while the force of the spring effects the closing or cutting motion as soon as the guiding path has ended. According to a further refinement of the present thought of invention, the trailing end of the movable shank may be angled off in the direction of the adjacent other arm of the device which, on this side, is provided with a guiding path, sliding block or the like for the trailing end.

It was found that it is particularly useful if the two arms of the device, disposed one next to the other, are connected to each other by means of a dovetailed connection or the like.

If found necessary, the two arms may be movably supported one next to the other within a sleeve, or jacket or the like. It is also useful if stop means are provided between the two arms for limiting the relative motion between these two arms. These stop means will then determine, in each case, the depth of penetration of the needle, and also the advance of the blade, or respectively the return motion of the needle. They will determine also the length of the placed loop and therefore the length of the tufts of the tufted rug, which will, in this case, depend on the motion of the needle. If necessary, these stop means may be adjusted, so that the length of the stroke, and thereby the lengths of the tufts, may be varied.

Furthermore, the present invention comprises an embodiment in which the use of compressed air for guiding the thread is omitted. This embodiment is provided with a mechanical drive, and if need be an electric motor drive, for achieving the relative motion between the two arms. It was found that this can be achieved in a particularly simple manner if the drive system is provided with a motor-driven shaft having opposing eccentrics, of which the one eccentric engages the one arm, while the other eccentric engages the other arm. It is advantageous also if the driving motor is associated with a speed-regulating device (r.p.m.-regulator) which permits controlling the production rate in this manner.

BRIEF DESCRIPTION OF THE DRAWINGS

Further features, details, and advantages of the present invention may be derived from the following description of a number of embodiments represented herein in a simplified manner with the help of the drawings, in which:

FIG. 1 shows a perspective view of the device while the needle is penetrating the base fabric;

FIG. 2 shows a plan view of the device;

FIG. 3 a lateral view; and

FIG. 4 a bottom view of the device;

FIG. 5 shows a sectional view taken along line V—V in FIG. 1;

FIGS. 6, 7 and 8 illustrate the leading ends of the two arms in different working positions.

DESCRIPTION OF THE PREFERRED EMBODIMENTS

Figure 9:
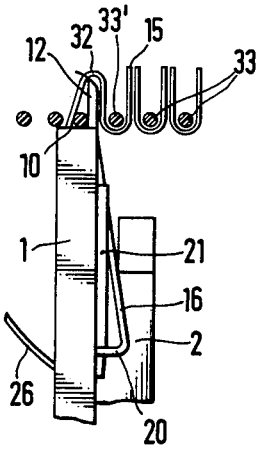
FIGS. 9, 10 and 11 show the device in a broken-off view during the placing of a loop.

The device serving for the tufting of rugs or the like comprises two arms 1 and 2 which, by means of a dovetail 4 on arm 2 engaging in a groove 3 of arm 1, are guided movably in longitudinal direction along each other. Both arms 1, 2 are provided at their trailing ends with a handle 5. Arm 2, furthermore, supports a stop means 6 which limits, between the two counter stop means 7 and 8 of arm 1, the back and forth motion of the two arms 1 and 2 against each other. This motion is indicated by double arrow 9.

At its leading end, arm 1 is provided with a contact surface 10 over which needle 12, secured on inner side 11, is projecting. The needle point 13 is bent off, or curved, by the amount $x$, toward arm 1. The needle point 13 is provided with a needle eye 14 through which thread end 15 is inserted. Needle 12, in FIGS. 6 and 7, forms a groove which is concavely open toward the viewer. A blade 16, provided in the form of a pair of scissors, is disposed on the other arm 2, This blade projects freely over the leading contact surface 17 of arm 2. Blade 16 comprises a stationary blade arm 18 and the movable blade or scissors' arm 10. The trailing end 20 of arm 19 is angled off in the direction of arm 1 and engaged at that point in a guiding path 21 which, in association with the angled-off end 20, effects the opening motion of the blades. A spring 22, provided in the form of a tension spring, acts furthermore on the trailing end 20 of the movable blade arm 19, thereby counteracting the opening motion of blade 16. The length of the guiding path 21, arranged on blade arm 1, is slightly less than the maximum stroke $y$ of the two arms 1 and 2 against each other. In its most rearward position, the angled-off end 20 of scissor arm 19 is positioned to the rear of trailing end 23. In the most forward position of its motion, it is positioned in front of the most forward end 24 of guiding path 21.

On the bottom side of the two arms 1 and 2, there is provided a guiding arrangement for guiding the thread 26 to be withdrawn from a thread coil 25. This guiding arrangement comprises the two thread guides 27 and 28 on arm 1, and thread guide 29 on the oppositely arranged arm 2. An additional thread guide 30 is provided on the forward or leading end of arm 1, with guide 30 feeding the thread end 15 to needle eye 14.

Figure 10:
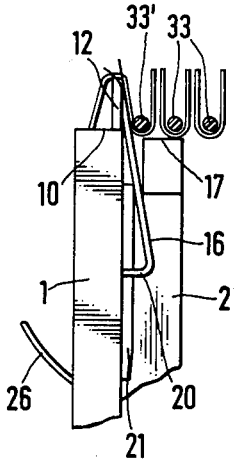
Figure 11:
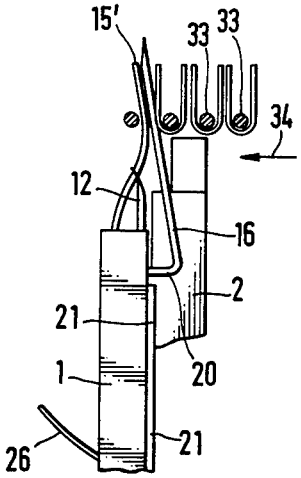

The mode of operation of the device according to the present invention is explained as follows:

In a position conforming to the one illustrated in FIGS. 1 to 4 and FIG. 6, i.e. in a position in which arm 1 is advanced as distinct to arm 2 supporting blade 16, the needle 12 penetrates into the stretched-out base fabric 31 of the rug to be tufted. The thread loop 32, in this step, is guided by the needle between two warp threads or wefts 3 of base fabric 31 about to such an extent as it will conform to the desired lengths of the tufts on the rug. This may be seen in particular in FIGS. 9 to 11. The free end 15 of thread 26 is placed around thread 33' of the base fabric. Arm 1 supports itself in this step with its leading contact surface 10 on base fabric 31. The projecting length of needle 12 conforms substantially to the height or length of the tufts to be provided on the rug. This may be derived from FIGS. 9 to 11. In this utmost or end position of the advance of needle 12, stop means 6 on arm 2 rests against stop means 7 provided on the other arm 1. Arm 2 with blade 16 will now advance while the stationary shank or arm 24 of the blade will slide in the concave groove of needle 12. The movable blade shank 19 with its angled-off end 20 runs up on guide path 21 (see FIG. 6), so that the scissors will be opened (see FIG. 7). The point of the blade enters between the same threads 33 of base fabric 31, through which needle 12 penetrated earlier, until contact surface 17 on arm 2 comes to rest on base fabric 31. The relative motion of the two arms 1 and 2 with respect to each other will now continue in the form of a return motion with arm 1 supporting needle. At this time the opened blade or scissors will receive loop 32 (see FIG. 10) until, during the return stroke of arm 1, the angled-off end 20 of blade shank 19 reaches the forward end 24 of guiding path 21. This action causes under the effect of spring 22 an immediate closing of the blade (see FIG. 11). While arm 1 is performing its return movement, thread 26 slides through the eye of needle 12. The relative motion between arms 1 and 2 is continued until the stop means 6 of the one arm comes to rest against stop means 8 of the other arm. The reversal of the relative motion of the two arms begins now from this position, and commences with an advance of arm 1 supporting needle 12. As a result of the fact that point 13 of needle 12 is bent off or curved laterally in the direction in which the tufting work is progressing (arrow 34), the needle will now penetrate into base fabric 31 not at the point of the preceding penetration but rather at a point displaced by one warp thread or weft 33 in the direction of arrow 34. This action conforms to the way in which the tufting work of the device advances from one loop formation to the next one. The above process is now repeated for forming new loop. The supply of thread required solely for the formation of loops is withdrawn during the advance motion of arm 1 with needle 12 from thread supply 25 by way of thread-guiding elements provided on both arms 1 and 2.

Figure 12:
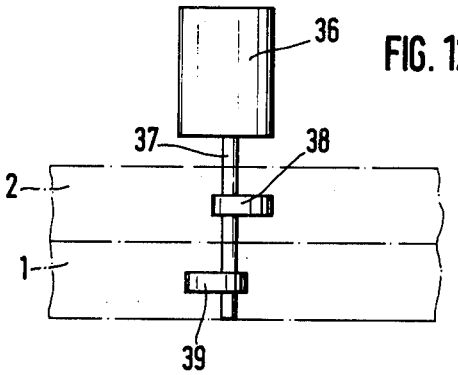
FIG. 12 illustrates a single motor drive for the two arms.

FIG. 12 illustrates a schematic view of a single driving device serving the purpose of effecting the relative back and forth motions of arms 1 and 2 in the direction of arrow 9. It operates by means of an electric motor 36 which may comprise, if desired, a speed-regulating device not shown here in detail. This arrangement comprises a shaft 37 provide with two opposing eccentrics 38 and 39, of which the one eccentric engages on arm 1, and the other arm 2 of the tufting device.

Figure 13:
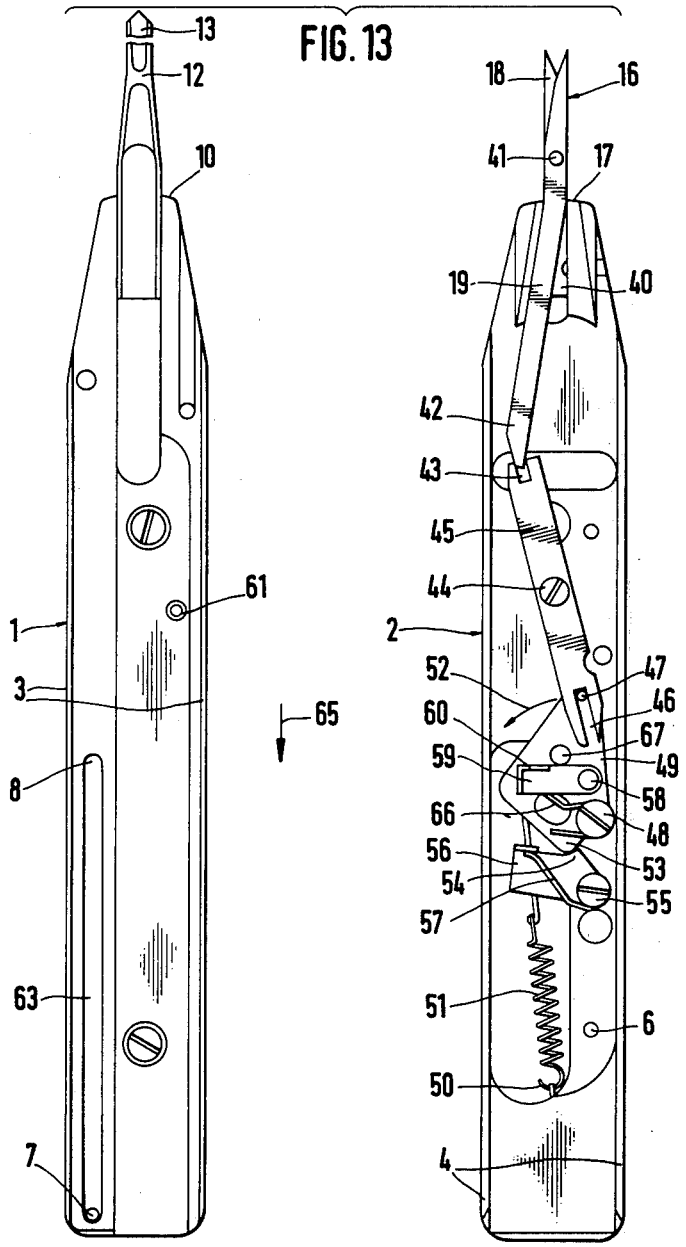
FIG. 13 shows another embodiment of the device with the two arms in a pulled-apart position.
Figure 14:
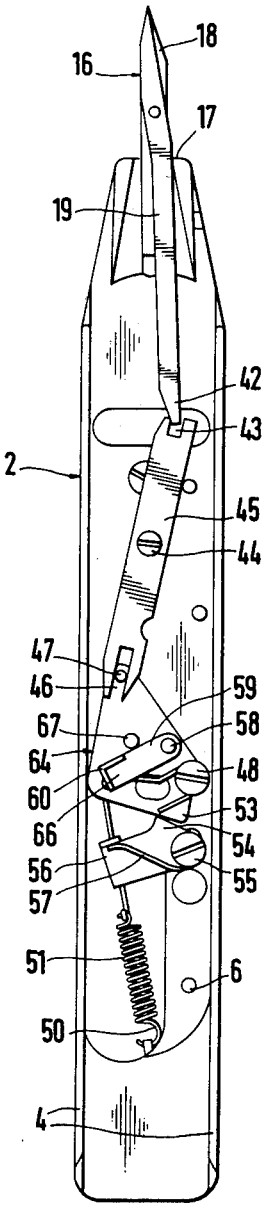
FIG. 14 shows the second arm in the closing position of the blade.

The embodiment according to FIGS. 13 and 14 is also based on the basic concept of the present invention. This embodiment comprises the two arms 1 and 2 guided longitudinally with a relative motion between each other. The one arm 1 supports at its leading end a needle 12, whereas the blade 16, provided in this case in the form of a pair of scissors, is disposed on the other arm 2. The shank 18 of blade 16 is secured with its trailing end 40 on arm 2. The movable shank 19 of the blade arrangement is pivotably supported on the stationary shank 18 by way of pin or riveted joint 41. The extending trailing end 42 of the movable blade 19 engages in a fork 43 of a twin lever 45 which is pivotable around pivoting point 44. The other end of the twin lever is provided with another fork 46. A pin 47 of a swiveling arm 49 supported on a screw 48, engages in fork 46. The swiveling arm 49 is under the effect of a tension spring 51 secured with its ends 50 on arm 2. The swiveling arm 49 is prevented from the swiveling motion caused by the spring in the direction of arrow 52, around swiveling point 48, by its cam 53, causing it to rest against a stop means 54 of a stop lever 56. This stop lever 56 is supported pivotably around the pivoting point formed by screw means 55. The stop lever, in the position shown in FIG. 13, is under the effect of a spring means 57 opposite cam 53 of swiveling arm 49. Another stop lever 59, provided with a stop means 60, serves for actuating swiveling arm 49. The stop lever 59 is pivotably supported on the swiveling arm 49 by means of riveted joint 58, while stop means 60 projects into the path of movement of a counter stop means 61 serving as the guiding member. The mechanism shown in FIG. 13, which comprises the twin lever 45, the swiveling arm 49, the stop lever 56 including the various spring means, and the further stop lever 59, is accommodated in a recess 61 of arm 2. According to the assembly of the two arms 1 and 2, according to FIG. 13, the stop means 6, for example a setscrew or the like, projects into the slot-shaped recess 63, so that the longitudinal motion of the two arms 1 and 2 against each other is limited by stop means 7 and 8 at the end of the slot-shaped recess 63.

FIG. 14 illustrates the entire actuating mechanism 64 for blade 16 while the latter is in its closed position. The cam 53 and stop means 54 are disengaged, and tension spring 51, which acts upon swiveling arm 49, is in its relieved position. If arm 1 of the device is now displaced opposite arm 2 in the direction of arrow 65, counter stop means 61 runs up on stop means 60 of stop lever 59 which, under the effect of spring 66, is resting against a stop head 67 disposed on swiveling arm 49. However, the stop lever 59 is capable of giving way around its pivoting point 58 against the force exerted by spring 66, so that counter stop means 61 can pass by and arrive behind stop means 60 of stop lever 59. Arm 1 is now advanced again relative to arm 2 against the direction indicated by arrow 65, whereby counter stop means 61 arrives on arm 1 and comes to rest against the reverse side of stop means 60 on stop lever 59 connected to swiveling arm 49. However, the stop lever 59 is resting against stop head 67, so that the further advance of counter stop means 61 together with arm 1 will guide the entire swiveling arm 49 around its pivoting point 48 into the position shown in FIG. 13. During this action, pin 47 will take along twin lever 45, and the latter in turn takes along the movable blade shank 19. By this action, blade 16 is passed from the closed position, shown in FIG. 14, into the open position, according to FIG. 13. Cam 53 on swiveling arm 49 engages with stop arm 56 while tension spring 51 is simultaneously tensioned. Mechanism 64 remains in this position while blade 16 is open at the same time (compare FIG. 13, right-hand illustration). If arm 1 is now returned again in its guiding path opposite arm 2 in the direction of arrow 65, counter stop means 61 will again run past stop means 60 of stop lever 59. In the reversed motion of arm 1 opposite arm 2, the counter stop means 61 will take along swiveling arm 49 by way of stop means 60 against the direction of arrow 52 to such an extent that cam 53 will release pawl 54, and stop lever 56 will spring back into the position, according to FIG. 14. If counter stop means 61 then continues in its path and slides off stop means 60, swiveling arm 49, under the force exerted by spring 51, returns to its position, according to FIG. 14, and the blade is closed at the same time.

I claim:

1. A device for manually tufting rugs with a base fabric and the like comprising a fixed needle for guiding thread and penetrating the base fabric to form thread loops; a blade disposed movable in a longitudinal direction relative to said needle for cutting the thread after the formation of each loop at the head of the loop; two arms disposed one next to the other; means for guiding said arms movable relative to each other in longitudinal direction, each of said arms having a leading contact surface for alternately contacting the base fabric, one of said arms supporting said needle, said needle projecting from the contacting surface of said one arm, the other of said arms supporting said blade, said blade projecting over the contacting surface of said other arm, said other arm having a guiding member, said blade having means engaging said guiding member of said other arm for opening said blade; and spring means for closing said blade when in substantially its most advanced position, said one arm having a recess for receiving said means engaging said guiding member, said means engaging said guiding member having a swiveling arm actuating said blade, said swiveling arm being actuated by said spring means in the closed position of said blade, and arrester means releasable by said guide member, said swiveling arm cooperating with said arrester means in the open position of said blade for engaging said arrester means; a twin lever, said blade having a movable blade shank with a trailing end, said twin lever being interconnected between said swiveling arm and the trailing end of said movable blade shank.

2. The device as defined in claim 1, wherein said needle has a curved point bent in the direction of progression of the tufting operation.

3. The device as defined in claim 1, wherein said needle has means for guiding the thread by said two arms disposed movably relative to each other.

4. The device as defined in claim 1, wherein said needle forms a groove curved concavely toward said blade.

5. The device as defined in claim 1, including means for limiting a maximum stroke of motion of said two arms relative to each other, said stroke having a magnitude corresponding substantially to the total length of the thread forming a loop.

6. The device as defined in claim 1, wherein said blade comprises a pair of scissors having a shank connected to said arm, said movable shank being connected to said guiding member, said movable shank being actuated by said spring means in a closing direction.

7. The device as defined in claim 6, wherein said other arm has a guiding path, the trailing end of said movable blade shank engaging said guiding path, said guiding path ending with the length of motion of said arms corresponding to the cut.

8. The device as defined in claim 7, wherein said trailing end of said movable blade shank is angled off in the direction of the adjacent arm, said adjacent arm comprising said one arm and having a slotted path for receiving said trailing end.

9. The device as defined in claim 1, including dovetail guide means for connecting said two arms to each other.

10. The device as defined in claim 1, including stop means between said two arms for limiting the relative motion of said arms with respect to each other.

11. The device as defined in claim 1, wherein said arrester means includes auxiliary spring means for actuating said arrester means in the direction of said swiveling arm, said arrester means comprising a pivotably supported arm.

12. The device as defined in claim 1, including a swingable stop arm on said swiveling arm, said stop arm being arranged in the path of movement of said guide member and moving resiliently in one direction of movement of said guide member, said stop arm forming stop means in the opposite direction of movement of said guide member.

13. The device as defined in claim 1, including drive means between said two arms for applying relative motion between said arms.

14. The device as defined in claim 13, wherein said drive means comprises a motor with a driven shaft; two oppositely directed eccentrics driven by said shaft, one of said eccentrics engaging one of said arms, and the other of said eccentrics engaging the other one of said arms.

15. Apparatus for manually tufting rugs and the like comprising, in combination: two arms located next to each other; dovetailed joint means for connecting said arms to each other and guiding said arms movably relative to each other in a longitudinal direction between two extreme positions; stop means for defining said two extreme positions; leading contact surface means on each of said arms for alternately contacting the base fabric; a needle carried by one of said arms and projecting from its respective contact surface means, said needle penetrating the base fabric and holding thread; a blade carried by the other arm and projecting from its respective contact surface means, said blade cutting the thread after formation of a loop at the head of the loop; a guidance member for the other arm, said blade having means engaging said guidance member for opening said blade; closure means on said blade and triggered in the leading extreme position of the arm carrying said blade; and spring means; said closure means closing said blade under spring action when triggered in said extreme position.

16. Apparatus as defined in claim 15 including thread supply elements movable relative to each other and located on said two arms.

17. Apparatus as defined in claim 15 wherein said blade comprises a scissor with a first blade shankk fastened to one arm and a second blade shank interacting with said guidance member; and spring means for applying a force to said second blade shank in the direction of closing said scissor.

18. Apparatus as defined in claim 17 wherein said second blade shank has a rear end engaging a guidance track on the other arm, said guidance track ending at a stroke length of said arms corresponding to a cut.

19. Apparatus as defined in claim 18 wherein said rear end of said second blade shank is angled in a direction of the adjacent arm, said adjacent arm having contours guide means for said rear end.

20. Apparatus as defined in claim 17 wherein one of said arms has a recess for holding said closure means, said one arm having a swivel arm actuating said second blade shank; spring means for applying a force to said swivel arm and directed for closing said blade; detent arrester means interacting with said spring means and holding said swivel arm in open position of said blade, said detent arrester means being released by said guidance member.

21. Apparatus as defined in claim 20 wherein said detent arrester means comprises a pivotably supported arm; spring means acting on said pivotably supported arm in the direction of said swivel arm.

22. Apparatus as defined in claim 20 including a swingable stop arm on said swivel arm, said stop arm being located in the path of motion of said guidance member and retreating resiliently in one direction of motion of said guidance member, said stop arm forming stopping means in the opposite direction of motion of said guidance member.

23. Apparatus as defined in claim 20 including a twin lever between said swivel arm and trailing end of said movable blade.

24. Apparatus as defined in claim 15 including drive means between said two arms for applying relative motion between said two arms.

25. Apparatus as defined in claim 24 wherein said drive means comprises motor means; a shaft driven by said motor means and having opposite eccentrics, one of said eccentrics engaging one arm and the other eccentric engaging the other one of said arms.

* * * * *